US009671111B2

(12) United States Patent
Downing

(10) Patent No.: US 9,671,111 B2
(45) Date of Patent: Jun. 6, 2017

(54) FUEL SELECTOR VALVE WITH SHUTTER MECHANISM FOR A GAS BURNER UNIT

(71) Applicant: GHP Group, Inc., Niles, IL (US)

(72) Inventor: Verlon (Dan) Downing, Braselton, GA (US)

(73) Assignee: GHP Group, Inc., Niles, IL (US)

( * ) Notice: Subject to any disclaimer, the term of this patent is extended or adjusted under 35 U.S.C. 154(b) by 397 days.

(21) Appl. No.: 14/209,250

(22) Filed: Mar. 13, 2014

(65) Prior Publication Data

US 2014/0272741 A1 Sep. 18, 2014

Related U.S. Application Data

(60) Provisional application No. 61/779,369, filed on Mar. 13, 2013.

(51) Int. Cl.
*F23Q 9/08* (2006.01)
*F23N 1/02* (2006.01)
(Continued)

(52) U.S. Cl.
CPC ..... *F23N 1/027* (2013.01); *F23D 14/10* (2013.01); *F23D 14/60* (2013.01); *F23D 14/64* (2013.01);
(Continued)

(58) Field of Classification Search
CPC ..... F16K 11/048; F16K 17/04; F16K 24/04; F16K 31/003; F16K 31/1221;
(Continued)

(56) References Cited

U.S. PATENT DOCUMENTS 668,368 A 2/1901 Barkowskyi
2,747,613 A 5/1956 Reinhart
(Continued)

FOREIGN PATENT DOCUMENTS

CA 2391757 A 1/2003
CN 2430629 Y 5/2001
(Continued)

OTHER PUBLICATIONS

Empire Comfort Systems, "Installation Instructions and Owner's Manual, Premium Vent-Free Multi-Sided Fireplaces" Models VFP36SP32EN-2, VFP36SP32EP-2: Peninsula Fireplace Models: VFP36PP32EN-2, VFP36PP32EP-2, vol. 26670-5-1213, pp. 1-40 (Feb. 1, 2002).
(Continued)

*Primary Examiner* — Jason Lau
(74) *Attorney, Agent, or Firm* — Seyfarth Shaw LLP

(57) ABSTRACT

A selector valve and shutter mechanism for use with a gas burner unit is disclosed. The valve includes a pilot gas manifold which is in communication with two pilot flames and associated ODS for two different kinds of gas fuel. The shutter mechanism opens or closes an opening to a burner mixing chamber to thereby adjust the flow of air into the mixing chamber depending on the fuel selected, and preferably is in the form of a sleeve that in one approach is rotatably mounted on a part of the burner mixing chamber, with a part of the sleeve covering the mixing chamber opening in one orientation and opening it to airflow in another orientation. A first gear is mounted on the sleeve which is engageable with a second gear mounted on part of the valve which is rotatable to one position or another depending on the gas fuel selected, the sleeve thereby adjusting the airflow to the mixing chamber in response to the valve position. In another approach, the cover moves
(Continued)

linearly along the burner tube between orientations. A novel selector mechanism having a manifold for gas flows and a plate-like element to adjust the manifold is also disclosed.

12 Claims, 13 Drawing Sheets

(51) Int. Cl.
*F23N 5/24* (2006.01)
*F23D 14/10* (2006.01)
*F23D 14/60* (2006.01)
*F23D 14/64* (2006.01)

(52) U.S. Cl.
CPC ..... *F23N 5/242* (2013.01); *F23N 2021/10* (2013.01); *F23N 2035/06* (2013.01)

(58) Field of Classification Search
CPC ..... F16K 31/602; F16K 35/025; F16K 7/14; F16K 7/17; F16K 11/02; F16K 15/03; F16K 15/063; F16K 17/0433; F16K 17/38; F16K 1/465; F16K 3/06; F16K 17/28; F16K 1/12; F16K 1/38; F16K 27/003; F16K 31/408; F16K 39/045; F16K 51/02; F16K 11/0853; F16K 17/32; F16K 1/306; F16K 31/001; F16K 31/0655; F16K 11/083; F16K 11/0833; F16K 11/0836; F23C 1/08; F23C 1/00; F23C 7/008; F23C 7/006; F23C 2202/10; F23C 2900/06041; F23C 3/002; F23C 6/045; F23C 7/06; F23C 9/00; F02M 17/34; F02M 26/70; F24C 1/02; F23N 2035/24; F23N 1/005; F23Q 9/00; F23Q 9/02; A47B 88/04; A47B 2210/0029; A47B 88/0466; A47B 88/14; A47B 88/16; A47B 96/00; A47B 81/00; A47B 2063/005; A47B 47/0075; A47B 49/006; A47B 61/003; A47B 67/00; A47B 81/002; A47B 88/0051
See application file for complete search history.

(56) References Cited

U.S. PATENT DOCUMENTS 3,843,310 A 10/1974 Massi
4,118,175 A * 10/1978 Riehl ..... F23D 14/105 431/354
4,157,238 A 6/1979 van Berkum
4,243,176 A 1/1981 Hays
4,249,886 A 2/1981 Bush
4,329,137 A 5/1982 Werne
4,465,456 A 8/1984 Hynek et al.
4,509,912 A 4/1985 van Berkum
4,838,241 A 6/1989 Rieger
4,962,749 A 10/1990 Dempsey et al.
5,000,162 A 3/1991 Shimek et al.
5,437,304 A 8/1995 Delcroix
5,452,709 A 9/1995 Mealer
5,470,018 A 11/1995 Smith
5,591,024 A 1/1997 Eavenson et al.
5,674,065 A 10/1997 Grando et al.
5,795,145 A 8/1998 Manning et al.
5,807,098 A 9/1998 Deng
5,906,197 A 5/1999 French et al.
5,931,661 A 8/1999 Kingery
6,845,966 B1 1/2005 Albizuri
6,904,873 B1 6/2005 Ashton
6,938,634 B2 9/2005 Dewey, Jr.
7,044,729 B2 5/2006 Ayastuy et al.
7,048,538 B2 5/2006 Albizuri
7,174,913 B2 2/2007 Albizuri
7,201,186 B2 4/2007 Ayastuy
7,299,799 B2 11/2007 Albizuri
7,300,278 B2 11/2007 Vandrak
7,434,447 B2 10/2008 Deng
7,490,869 B2 2/2009 Iturralde et al.
7,528,608 B2 5/2009 Elexpuru et al.
7,600,529 B2 10/2009 Querejeta
7,607,325 B2 10/2009 Elexpuru et al.
7,607,426 B2 10/2009 Deng
7,634,993 B2 12/2009 Bellomo
7,637,476 B2 12/2009 Mugica et al.
7,641,470 B2 1/2010 Albizuri
7,651,330 B2 1/2010 Albizuri
7,654,820 B2 2/2010 Deng
1,677,236 A1 3/2010 Deng
7,730,765 B2 6/2010 Deng
7,758,323 B2 7/2010 Orue
7,766,006 B1 8/2010 Manning
7,861,706 B2 1/2011 Bellomo
7,902,476 B2 3/2011 Querejeta Andueza et al.
7,950,384 B2 5/2011 Albizuri
7,963,763 B2 6/2011 Albizuri
7,967,005 B2 6/2011 Parrish
7,967,006 B2 6/2011 Deng
7,967,007 B2 6/2011 Deng
8,011,920 B2 9/2011 Deng
8,028,549 B2 10/2011 Orue Orue et al.
8,051,849 B2 11/2011 Albizuri
8,057,219 B1 11/2011 Manning et al.
8,061,347 B2 11/2011 Manning
8,092,212 B2 1/2012 Albizuri
8,118,590 B1 * 2/2012 Manning ..... F23N 1/005 431/278
8,137,098 B2 3/2012 Uribetxebarria et al.
8,152,515 B2 4/2012 Deng
8,196,897 B2 6/2012 Albizuri Landa
8,235,708 B2 8/2012 Deng
8,241,034 B2 8/2012 Deng
8,281,780 B2 10/2012 Carvalho et al.
8,281,781 B2 10/2012 Deng
8,282,390 B2 10/2012 Albizuri
8,297,968 B2 10/2012 Deng
8,317,511 B2 11/2012 Deng
8,332,980 B2 12/2012 Orue Orue et al.
8,371,844 B2 2/2013 Querejeta Andueza et al.
8,403,661 B2 3/2013 Mateos Martin
8,405,411 B2 3/2013 Fernandez Llona et al.
8,413,648 B2 4/2013 Querejeta Andueza et al.
8,449,289 B2 5/2013 Albizuri
8,455,799 B2 6/2013 Mugica Odriozola
8,516,878 B2 8/2013 Deng
8,545,216 B2 10/2013 Deng
2003/0010952 A1 1/2003 Morete
2007/0277803 A1 12/2007 Deng
2007/0277813 A1 12/2007 Deng
2008/0227045 A1 9/2008 Deng
2010/0326422 A1 12/2010 Deng
2010/0326430 A1 12/2010 Deng
2010/0330518 A1 12/2010 Deng
2010/0330519 A1 12/2010 Deng
2011/0081620 A1 4/2011 Deng
2011/0143294 A1 6/2011 Deng
2011/0147631 A1 * 6/2011 Menassa ..... F24F 13/12 251/205
2011/0215690 A1 * 9/2011 Juan ..... A47B 88/08 312/319.1
2012/0132189 A1 5/2012 Deng
2013/0037014 A1 2/2013 Deng
2013/0122439 A1 5/2013 Deng
2013/0149652 A1 6/2013 Deng
2013/0209944 A1 8/2013 Deng
2014/0030665 A1 1/2014 Deng

FOREIGN PATENT DOCUMENTS

CN 1844742 A 10/2006
CN 1873268 A 12/2006
CN 2901068 Y 5/2007

(56) References Cited

FOREIGN PATENT DOCUMENTS

| | | | |
|---|---|---|---|
| CN | 1844742 | B | 4/2010 |
| DE | 720854 | | 5/1942 |
| EP | 0805310 | A1 | 11/1997 |
| EP | 0915295 | A2 | 5/1999 |
| EP | 0915295 | A3 | 5/1999 |
| FR | 1517003 | | 2/1968 |
| FR | 2642148 | A1 | 7/1990 |
| GB | 1165762 | | 10/1969 |
| GB | 1298809 | | 12/1972 |
| GB | 1329893 | | 9/1973 |
| JP | 1444673 | | 8/1976 |
| JP | 51114989 | A | 10/1976 |
| JP | 58219320 | | 12/1983 |
| JP | 58219320 | A | 12/1983 |
| JP | 59009425 | A | 1/1984 |
| JP | 62169926 | A | 7/1987 |
| JP | 03230015 | | 10/1991 |
| JP | 10141656 | | 5/1998 |
| JP | 11192166 | A | 7/1999 |
| JP | 11193929 | A | 7/1999 |
| JP | 11344216 | A | 12/1999 |
| JP | 2000234738 | A | 8/2000 |
| JP | 200356845 | A | 2/2003 |
| JP | 2003065533 | | 3/2003 |
| JP | 2003074837 | A | 3/2003 |
| JP | 2003074838 | A | 3/2003 |
| JP | 2003083537 | A | 3/2003 |
| JP | 2003090498 | A | 3/2003 |
| JP | 02003090517 | A | 3/2003 |
| JP | 2010071477 | A | 4/2010 |
| WO | 2006084690 | A2 | 8/2006 |
| WO | 2008071970 | A1 | 6/2008 |

OTHER PUBLICATIONS

Heat Wagon "Installation and Maintenance Manual, S1505 Construction Heater", pp. 1-13 (Revision Jul. 29, 2002).

Vanguard "Unvented (Vent-Free) Propane/LP Gas Log Heater, Owner's Operation and Installation Manuel" Flame-Max Golden Oak Log Design, 18", 24", 30", 36" Remote Ready Model, vol. 105274-01, Rev. B., pp. 1-26, Feb. 1999.

White Mountain Hearth, Empire Comfort Systems "Installation Instructions and Owner's Manual", The Vail Vent-Free Gas Fireplaces, Unvented Gas Fireplace Models VFP32FP(20,21)L(N,P)-1, VFP32FP(30,31)L(N,P)-1;VFP36FP(20,21)L(N,P)-1;VFP36FP(30,31)L(N,P)-1; vol. 20101-0-0306, pp. 1-28, Mar. 2006.

White Mountain Hearth, Empire Comfort Systems "Installation Instructions and Owner's Manual", The Vail Vent-Free Gas Fireplaces, Unvented Gas Fireplace Models VFHD-32(T,TV)-1; VFHD-32(R,RV)-1;VFHD-36(T,TV)-1; VFHD-36(R,RV)-1; vol. 16005-I-0204, pp. 1-28, Feb. 2004.

White Mountain Hearth, Empire Comfort Systems "Installation Instructions and Owner's Manual", The Vail Vent-Free Gas Fireplaces, Unvented Gas Fireplace Models VFHD-32(T,TV)-1; VFHD-32(R,RV)-1;VFHD-36(T,TV)-1; VFHD-36(R,RV)-1; vol. 14010-0-0403, pp. 1-28, Apr. 2003.

Empire Comfort Systems "Installation Instructions and Owner's Manual", Unvented Gas Fireplace Models VFHS-36T-1, VFHS-36R-1; vol. VFI-S-36, pp. 1-28, Mar. 2001.

Empire Comfort Systems "Installation Instructions and Owner's Manual", Unvented Gas Fireplace Models VFH-33M-1, VFH-33R-1; VFH-33T-1, vol. VHF-33, pp. 1-32, Apr. 2001.

Odesa Heating Products, "Technical Service Training Manual," pp. 1-98, (2004).

"Jotul GF 3 BV Allagash B-Vent Gas Heater Installation and Operation Instructions," Warnock Hersey, Model: Allagash B-Vent Gas Stove, vol. 129450, pp. 1-24, Dec. 2000.

Flagro Industries Limited, "Flagro Products Listing, Dual Fuel Heaters Propane or Natural Gas Fired," taken from http://www.flagro.on.ca/products_dual%20fuelhtrs.htm., pp. 1-2, dated Sep. 28, 2011.

"Country Flame Technologies, Installation, Operation and Maintenance Manual," Inglenook Fireplace Gas Log Set, Model INGLS 24-N or INGLS 24-P, Natural Gas or Propane Conversion Kit, Tested by Warnock Hersey, Version 1.0b, pp. 1-34, (2004).

"Operating Instructions Manual for F-400T Dual Fuel Construction Heater," Flagro Industries Limited, pp. 1-17, 2000.

Empire Comfort Systems, Listing of Pricing and Manuals, Surround Yourself With Comfort, taken from http://web.archive.org/web/20020329061925/http:/dev.obatadesign.com/clients/Empire/ma . . . pp. 1-3, dated Apr. 26, 2014.

Empire Comfort Systems, Surround Yourself With Comfort, Select Product, taken from http://web.archive.org/web/20030722175204/http:/empirecomfort.com/ p. 1, dated Apr. 26, 2014.

Flagro Industries Limited, "Flagro Products Listing, Dual Fuel Heaters Propane or Natural Gas Fired," taken from http://web.archive.org/web/20041124032708/http://www.flagro.on.ca/products_dual%20fu . . . , pp. 1-2, dated Sep. 28, 2011.

* cited by examiner

FUEL SELECTOR VALVE WITH SHUTTER MECHANISM FOR A GAS BURNER UNIT

CROSS-REFERENCE TO RELATED APPLICATIONS

The present application claims priority from U.S. application Ser. No. 61/779,369, filed Mar. 13, 2013, which is incorporated by reference herein in its entirety.

FIELD OF THE INVENTION

The invention relates generally to gas burning units, such as vent free log sets, fireplaces, wall heaters and similar devices and, in particular, to an apparatus and methods by which fuel lines may be selected, and more particularly, the type of fuel and airflow to a burner of a gas heating unit may be selected and regulated.

BACKGROUND OF THE INVENTION

Currently, heating units, such as fireplaces, are desirable features in the home. Devices that burn non-solid materials, such as gas, or that produce heat electrically have gradually gained popularity. Like wood, the combustion of gas can provide "real" flames, and heat, but oftentimes entails a careful mixing of gas and air for desired or optimal performance, and a realistic flame. This aspect of the gas fireplace, and similar appliances, typically involves the delivery of air for combustion to an arrangement or device where the air is mixed with gaseous fuel, e.g., natural gas (NG) and liquid propane (LP) ("gas"). Clearly, it is advantageous that the air and gas are mixed at a ratio for proper combustion. Then, the mixed air and gas are delivered to a burner element or member, and ultimately provided to a combustion chamber of the fireplace. The mixing of air and gas is oftentimes accomplished in the burner itself.

There has also been a desire by some, such as stores and dealers that sell fireplaces and the like, to have a unit that can operate on different kinds of fuel. In many homes and other buildings, there may be NG or LP available. Sellers may therefore ask for a unit that can be adapted for either NG or LP, depending on what source of gas is available, or desired for the installation. Accordingly, units that may be configured to operate with more than one fuel source were developed. These are typically referred to as "dual-source" units. For example, the burner element may include a valving system that, when in one position, allows the unit to operate with a first fuel, and when in a second position, allows the heating unit to operate with a second fuel. These dual-source units are typically set up so that a choice of fuel is made by the installer when the unit is first put into operation. While dual-source burner units have been in the art for decades, there is always a desire to make the units simpler to use and lower in cost.

Further, when used indoors, longstanding regulations also require that an oxygen depletion sensor or system, be provided. The ODS is used to ensure that if there is a significant drop in the oxygen in the area of the unit, the fire will be extinguished.

SUMMARY OF THE INVENTION

In accordance with an aspect in one embodiment, a valve configured to allow selection of a fuel is provided with an associated shutter source for mixing air with the chosen fuel. The valve is essentially set up to operate in two configurations: one for use with natural gas (NG), and the other for use with propane (LP). In this embodiment, gas flows to selected pilot mechanisms associated with respective oxygen depletion sensing devices (ODS). A selector knob is mounted on an axel or rod of the valve, which is associated with an internal valve mechanism that rotates with the axel to open and close passageways in a manifold through which gas flows and is directed. The gas flow controlled by the valve is determined by whether the knob is placed in an NP or LP position.

An innovative shutter mechanism for controlling the flow of air into a burner, and particularly a mixing chamber associated with the burner for mixing the gas with air, is provided. The shutter mechanism preferably in one embodiment has a sleeve element which is tubular in shape, and which surrounds a tubular burner part, such as a lead-in segment to the burner element. This segment may comprise a mixing chamber, where ambient air is mixed with the selected fuel. The sleeve element in this version has at least a portion which is a cut-out or open area through the sleeve.

The tubular burner part has at least one opening or port which extends into the tubular burner part, and provides an airflow passage for air into the tubular burner part, so that the air can mix with gas flowing through the burner unit. In this embodiment, the sleeve element is located so as to rotate about the axis of the tubular burner part in a manner to open and close the airflow passage of the tubular burner part, by appropriate rotary movement of the sleeve element to place its sleeve opening in alignment with the airflow passage of the tubular burner part, or out of alignment. Depending upon how the opening/passage alignment is selected, more air enters into the mixing chamber for LP, or little to no air through the tubular burner part passage for NG.

In this embodiment, a first gear or sprocket is secured to the sleeve element, such as concentric with the sleeve element (i.e., the gear teeth extend radially from the sleeve element). A second gear or sprocket is secured to the knob or axel of the valve. The first and second gears are arranged to be engageable, such as in a right-angle arrangement with teeth meshing.

Accordingly, when the selector knob is rotated to a selected position (NP or LP), the valve axel turns and the sleeve element rotates in conjunction with the valve movement. The innovative shutter thus works in conjunction with the selector knob rotation.

In one aspect of the invention, a shutter device for use in a dual-fuel gas burner apparatus has a valve with a manifold therein, through which a first and a second gas are selectively routed. The valve preferably has a rotary axel which when rotated on its axis communicates first and second gases with a respective pathway in the manifold.

A knob is provided on the axel which is manually rotatable to select a first gas position or a second gas position. There is a burner mixing chamber within which a selected gas passes. The mixing chamber has a mixing opening for allowing ambient air into the mixing chamber interior to mix with gas therein. A cover is movably mounted to change the area of the mixing opening, and thereby the airflow therethrough; the airflow may be substantial in one orientation, or substantially or totally eliminated by movement of the cover in another orientation.

Movement of the cover in this embodiment is effected with a first gear mounted to turn with the axel. A second gear is mounted to move the cover. The first and second gears are engaged, whereby rotation of the selector knob places the cover in a position desired for a selected gas.

In one preferred aspect of the invention, the first and second gears are toothed gears, or sprockets, having teeth engaging in use. For example, the first gear is a first sprocket having radially extending teeth over at least a portion thereof, and the second gear is a sprocket having radially extending teeth over at least a portion thereof.

In the foregoing embodiment, the axel is biased into a locked condition in which the gears are engaged. When the axel is pushed against the bias, it becomes unlocked and rotatable, sufficient clearance in the gears allows inward motion of the knob without binding and facilitates radial meshing.

In one form, the shutter device has a burner mixing chamber which is generally circular in radial cross section. The cover is formed as a sleeve element co-axial with the burner chamber, and having a part which overlies the mixing chamber opening in one orientation to reduce if not substantially close airflow to the mixing chamber. In another orientation, the sleeve has at least one open area or cutout therethrough, which aligns with the one or more openings in the burner mixing chamber sidewall, for airflow into the mixing chamber. The sleeve is rotatably mounted on the burner mixing chamber, with the second gear being fixedly mounted to the sleeve.

In another aspect of the invention, the shutter device may further include an auxiliary airflow device for providing another airflow to the mixing chamber interior. Here, the auxiliary airflow device has a first plate with at least one first plate orifice therethrough, where the first plate orifice communicates with the mixing chamber interior, and a second plate having at least one second plate orifice therethrough which communicates with ambient air. The first and second plates are in facial engagement and rotatable relative to each other, such that the first plate orifice can be placed in alignment with the second plate orifice to provide an auxiliary airflow to the mixing chamber in a second position, and reduce if not substantially close the auxiliary airflow to the mixing chamber in a first position wherein the first and second plate orifices are not in alignment. In still another aspect of the invention, a shutter mechanism for controlling an airflow into a burner mixing chamber, is disclosed. The burner mixing chamber may receive a first gas flow or a second gas flow depending upon selection of the first or second gas flow by a manually operated selector mechanism. Here, a burner part has a mixing chamber opening to ambient air communicating with the mixing chamber. The burner part is preferably tubular and has a longitudinal axis.

A cover is mounted to overlie the mixing chamber opening in one orientation to reduce if not substantially close airflow through the mixing chamber opening, and to expose the mixing chamber opening in another orientation. In this embodiment, the cover moves along said longitudinal axis according to selection of the first or second gas flow. This linear movement is in contrast to the rotational movement of the covers of the embodiments previously discussed.

Movement of the cover is accomplished with a biasing member, such as a coil spring, biasing the cover to move between one orientation or another. The biasing member is actuated by the selector mechanism in this embodiment. That is, when a pathway for one gas flow is selected, such as between NG or LP, the selector mechanism also would move the cover (assuming the cover needs to be moved for that type of gas).

In one form of the foregoing embodiment of linear moving shutter, the selector mechanism includes a plate mounted orthogonal to the tube longitudinal axis. This plate is movable about the longitudinal axis. A rod is connected to the cover and has a rod end engaging the plate along a face of the plate. So engaged, the rod presses the cover against the bias of the biasing member in one orientation, essentially spring-loading the cover in that orientation. This may be to place the cover in an open position relative to the opening (or openings) to the mixing chamber.

The foregoing plate in this version is movable, as noted, and has an aperture, such as a notch, formed therethrough. When the plate is moved to another orientation, the rod end becomes disengaged from the plate face, passing through the notch. The bias applied to the cover thereby moves the cover along the burner tube to a closed (or covering) position over the opening(s) to the mixing chamber.

Besides operating the shutter as just described, another aspect of the invention is in the selector mechanism itself, for selecting and routing a first or a second gas flow to a burner unit of a gas-fired appliance. The burner unit could further include a pilot light, associated ODS and first and second pilot gas lines related to the first and second gas flows in a preferred form.

The selector of this aspect of the invention has a manifold with a burner gas inlet for a burner gas flow and a pilot gas inlet for a pilot gas flow, a burner gas outlet to the mixing chamber, a first pilot gas outlet to the first pilot gas line and a second pilot gas outlet to the second pilot gas line.

A plate member, such as that just previously discussed, is mounted to move in the manifold between the inlets and outlets. The plate member has a handle part located for manual movement of the plate, as by an installer, between a first orientation for the first gas flow and a second orientation for the second gas flow.

The plate member includes at least one pilot gas aperture therethrough which communicates (e.g., connects) the pilot gas inlet with either the first or the second pilot gas line, depending on either the first or second orientation being selected. There is at least one burner gas aperture through the plate which communicates (e.g., connects) the burner gas inlet with the burner gas outlet. In one version, the plate member has a first and a second burner gas aperture, and either the first or second aperture communicates with the burner gas outlet depending on which of the first or second orientation are selected. These burner gas apertures may be sized for a specific type of gas being supplied to the burner, as in a dual-fuel type burner. Advantageously, this novel selector also operates a linear shutter mechanism such as that described.

The aspects, advantages, features and details of the invention will be further understood in consideration of the following detailed description of certain embodiments taken in conjunction with the drawings, in which:

DETAILED DESCRIPTION OF EMBODIMENTS OF THE INVENTION

In the following detailed description, reference is made to the accompanying figures, which form a part thereof. In the figures, the same numbers typically identify similar components, unless context dictates otherwise. The illustrative embodiments described in the detailed description, figures, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are contemplated herein. For instance, while the invention is described hereafter in the context of a fireplace burner, it will be understood that the technology can be readily applied to applications in wall heaters and other types of "fires." Further, while this particular application for a fireplace is adapted for a so-called dual-fuel version, the invention may have application to routing the same kind of fuel along different selected paths.

Figure 1:
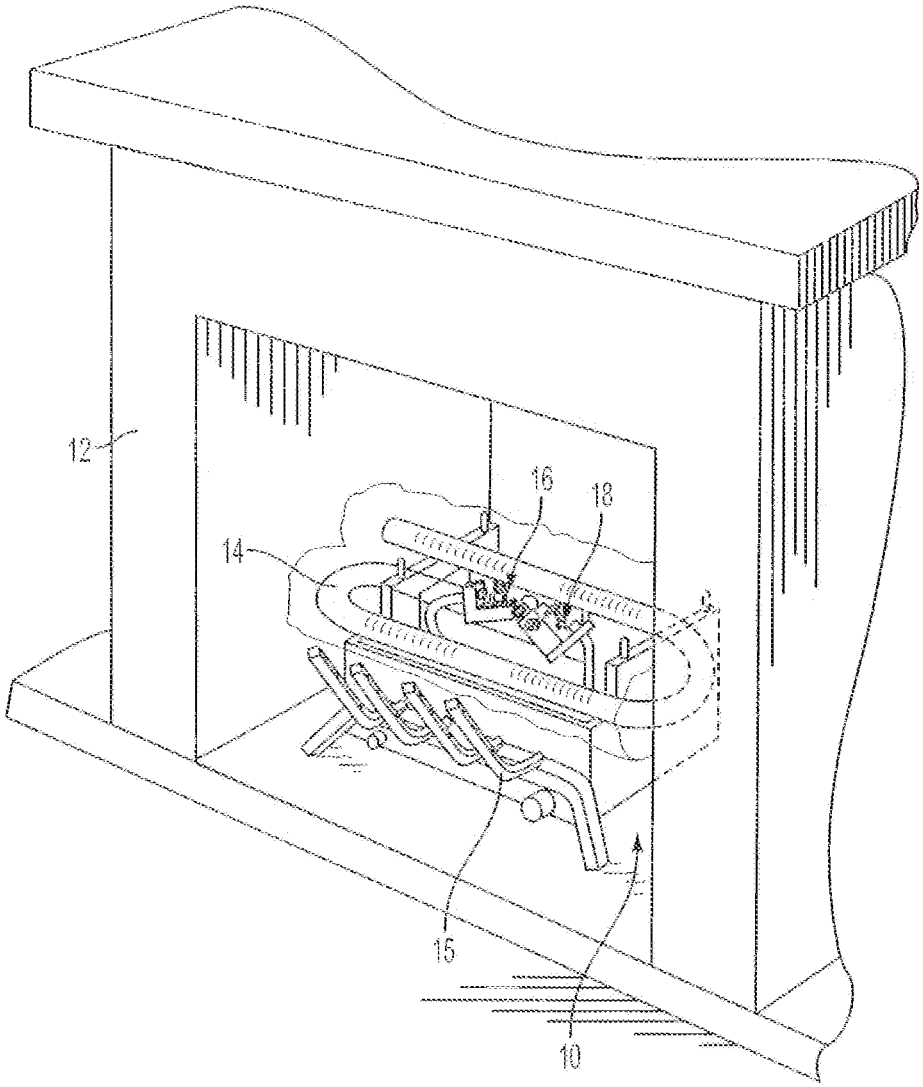
FIG. 1 shows a perspective view of a burner unit in a fireplace assembly as might be used with the present invention.

FIG. 1 shows an exemplary gas-fueled burner unit 10, which in one embodiment shown here, is provided in a fireplace assembly 12. In this version for a fireplace, there is a faux fireplace grate 15. Artificial logs are shown in dotted line about the burner unit. The invention is not limited to this type of burner or in a fireplace environment, but could be applicable to gas heaters and other gas fires. Gas burner unit 10 includes a burner element in the form of a burner tube 14. There is a pilot flame assembly which includes a pair of pilot light and oxygen depletion sensor (ODS) assemblies, indicated at 16 and 18, which will be described in detail and operation hereafter.

Figure 8:
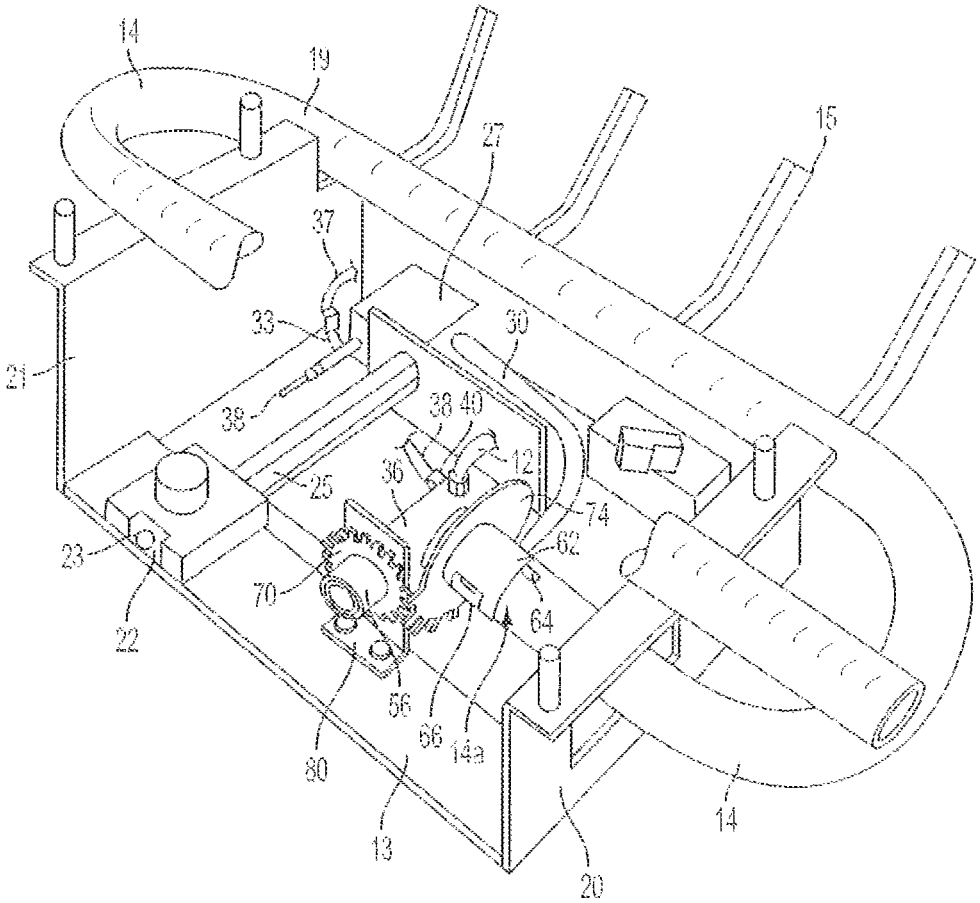
FIG. 8 is a top perspective view of the embodiment of FIG. 1, removed from the fireplace.
Figure 12:
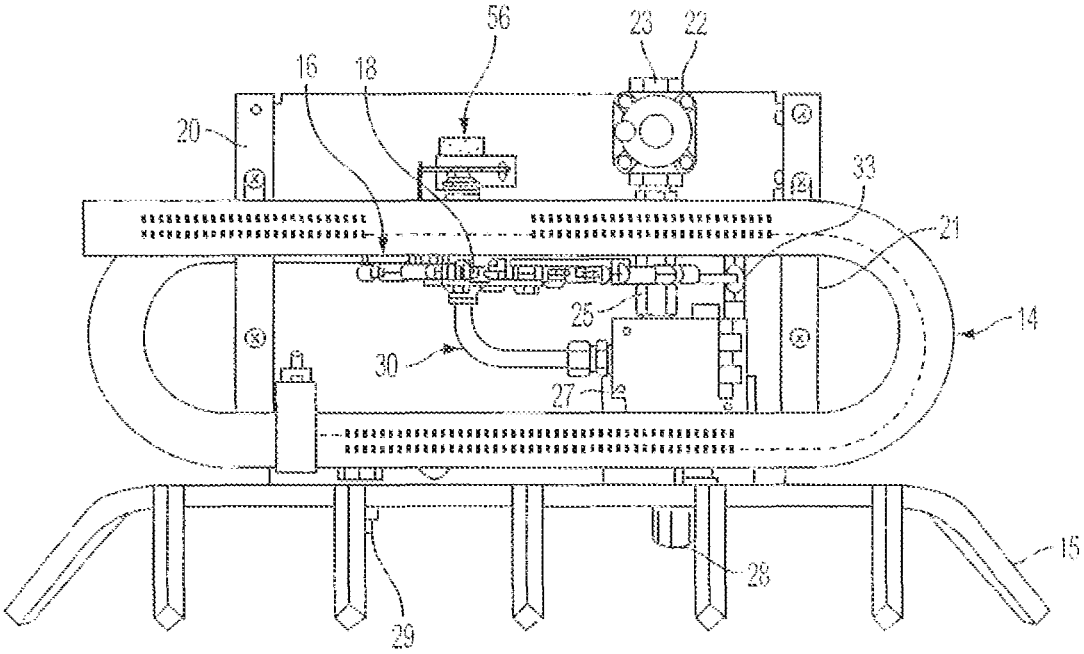
FIG. 12 is a top plan view of the embodiment shown in FIG. 8.

Turning now to FIGS. 8 and 12, some further details of the burner unit 10 can be seen. This burner element is in the form of a tube, curved upon itself at the elongated ends of the unit. The burner tube is mounted to opposed vertical side brackets 20, 21, with a base plate arrangement 13 therebetween, to which other burner elements are affixed or otherwise associated. Openings 19 for gas to pass from the tube interior for generating flames are shown. The burner element 14 need not be tubular, and could be a plate-type burner, or other conventional burner element. As will be understood, much of the burner unit 10 is conventional, with parts and operation well known to those of skill in the art. For instance, this system has a fuel delivery arrangement which permits the use of either natural gas (NG) or liquid propane (LP). This gives the installer, or homeowner, the option of choosing a fuel, assuming that the fuel option is available. It likewise provides the manufacturer and distributer with a system that can be used for either fuel, thereby providing the ability to reduce inventory (of units dedicated to one fuel or the other).

One or the other gas is fed from a source to a typical regulator unit 22, via a connector inlet opening 23. This regulator unit 22 is one supplied by Maxitrol. It is an adjustable regulator that is adaptable for either LP or NG, which are supplied at different pressures. From the regulator 22, the gas progresses through tube 25 to a standard-type main controller 27. In this version, a SIT 630 Eurosit controller 27 was used. The controller 27 has a gas level control knob 28 for adjusting the flame, as well as "off" and "pilot" positions. A typical igniter 29 for the burner would also be provided.

Figure 6:
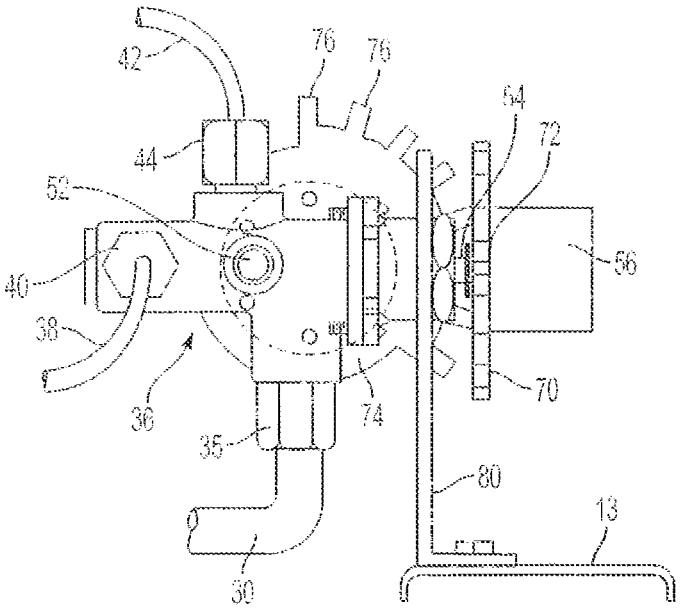
FIG. 6 is an end view of the structure shown in FIG. 4.
Figure 7:
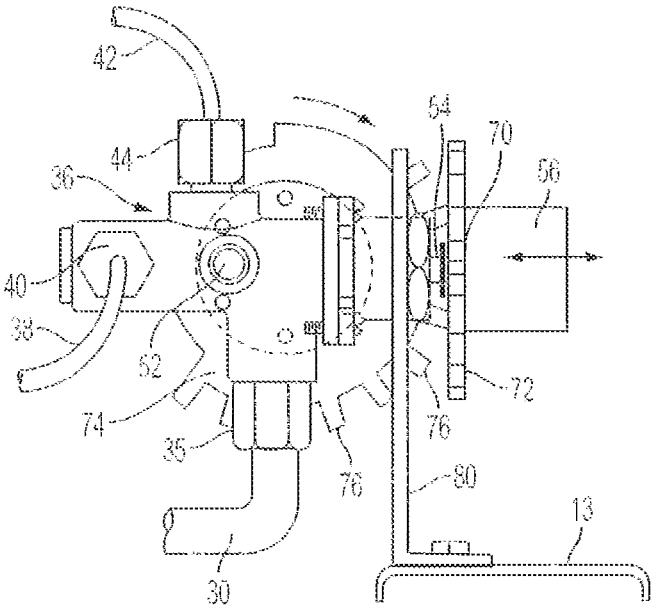
FIG. 7 is a view similar to that of FIG. 6, but with the gears rotated to a different orientation from that of FIG. 6.

Gas passes out of the controller 27 to a main gas line 30 (see, e.g., FIGS. 6 and 7), as well as to a Y-coupling 33. The main gas line 30 links with an inlet 35 to a selector valve 36 (FIGS. 6-8). There are two lines 37 and 38 that exit from the Y-coupling 33, which are for the two pilots and related ODS 16, 18 (best viewed in FIG. 13). The ODS assemblies are well known in the art, and are in fact mandated for indoor units.

Line 37 goes directly to the first pilot and ODS 18 assembly, which as will be further understood in the discussion below, is always fed (i.e., in NG or LP mode) in this embodiment. The other line 38 goes to the selector valve 36 and into a manifold therein, connecting to a rear side nipple 40 of the valve. This pilot gas line 38 input communicates through the valve manifold to a pilot gas line output 42 via connection to a top nipple 44. The pilot gas output line 42 then connects with the second pilot and ODS 16 assembly.

Figure 13:
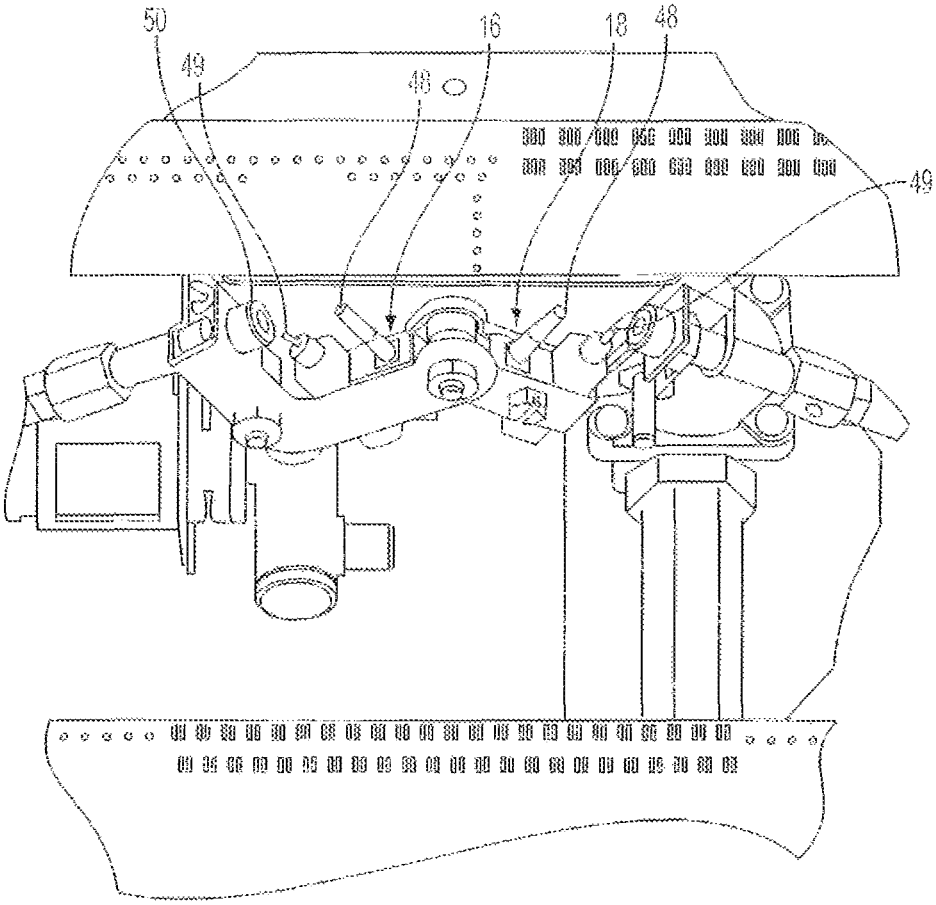
FIG. 13 is a perspective view of the pilot and related ODS units.
Figure 14:
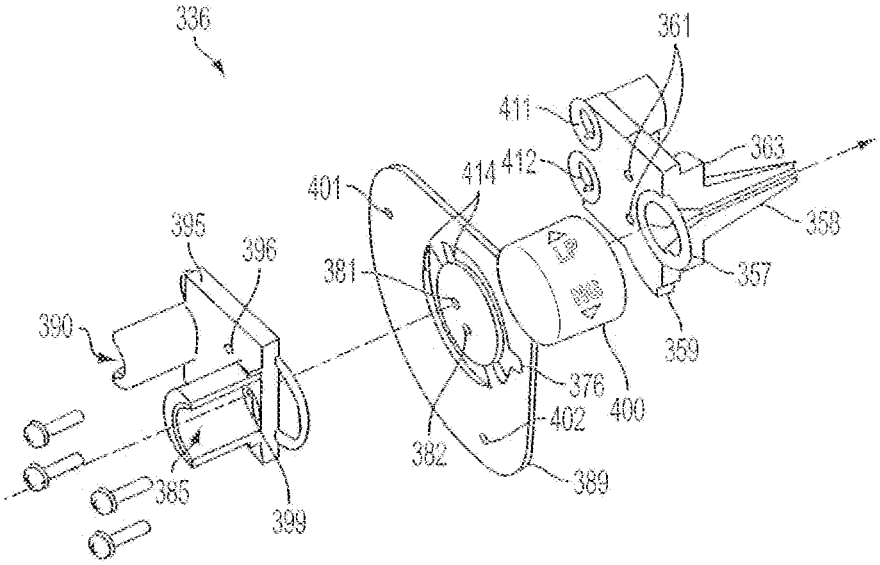
FIG. 14 is an exploded, front perspective view of a shutter mechanism in accordance with a third embodiment of the invention, with portions of the mechanism shown in cross-section.
Figure 15:
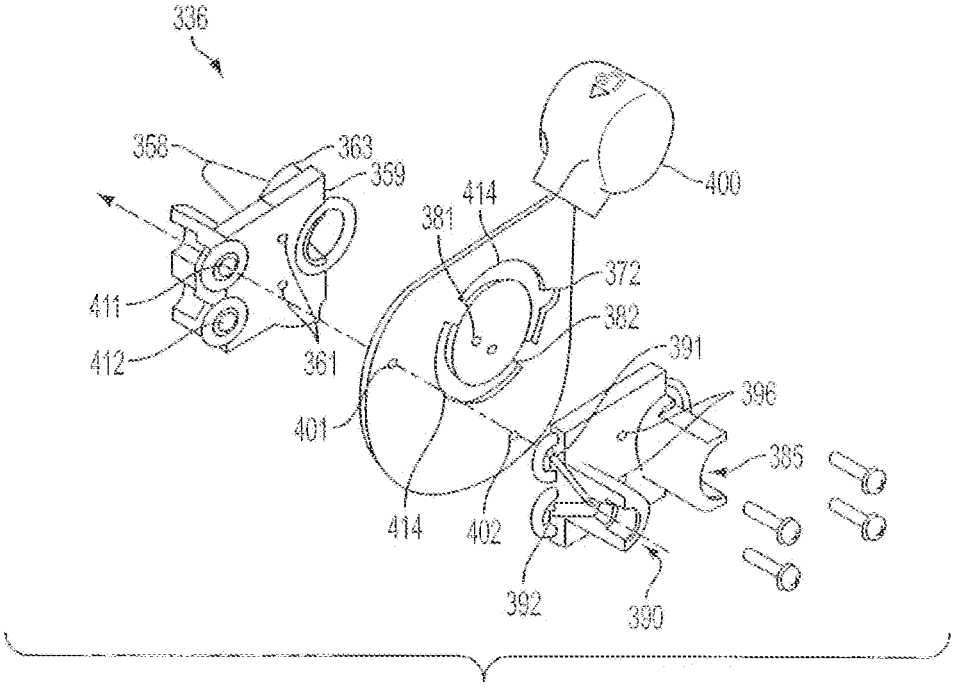
FIG. 15 is an exploded, rear perspective view of the shutter mechanism of FIG. 14, with portions of the mechanism shown in cross-section.

Referring now to FIG. 13, the first and second pilot/ODS assemblies 16, 18 are shown in more detail. This is a conventional arrangement, which utilizes two independent assemblies, each of which is used with a respective gas. Each assembly has a thermocouple 48 and an electrode or igniter 49. Gas from a respective pilot gas line is supplied through a nozzle 50 with each assembly.

Gas from a nozzle 50 is ignited and then provides a steady flame to one (for LP) or both of the two thermocouples 48 (for NG), depending upon which of NG or LP gas has been selected. The flame remains steady, provided that the oxygen content in the vicinity remains above a threshold level (typically around 18 percent or so). If the oxygen level drops below the threshold, the flame then lessons in strength as detected by the thermocouple (effectively, a temperature drop). This then triggers conventionally known circuitry associated with the ODS to close a gas control valve, shutting of the fuel supply to the burner 10.

Figure 4:
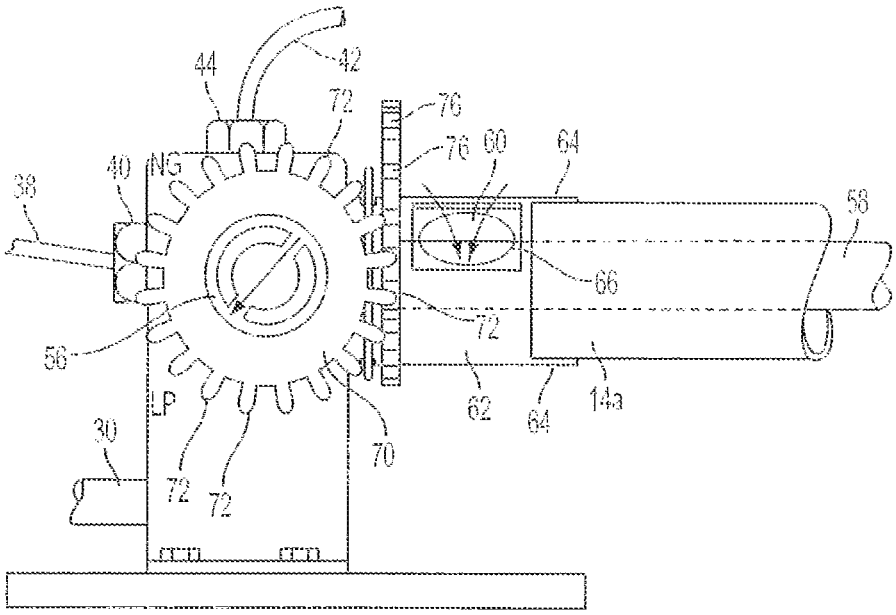
FIG. 4 is a side elevational view of the structure shown in FIG. 3, with airflow to the mixing chamber.

The selector valve 36 is a valve made by Copreci, model no. CPM 21400. Such a valve type is also shown in U.S. Pat. No. 7,766,006, which can be referred to for further details concerning this valve, its internal manifold structure, and its operation. Briefly, the valve 36 has an internal manifold which serves to route fuel through the valve to a certain outlet or outlets. The route is determined by rotation of an axel 54 e.g., (FIGS. 6 and 7) which places associated elements on the axel into or out of communication with an outlet(s). The axel 54 is manually rotated, as by an installer, through use of a selector knob 56, which is fixed to the outboard end of the axel. In this application, rotation of the axel 54 places the valve in a first configuration which does not allow LP gas to flow through the valve to the line 42 and thence to pilot/ODS assembly 16 (shown in the LP position in FIG. 4, for instance). LP gas, if connected, would nonetheless flow through line 37 (FIG. 8) to pilot/ODS assembly 18. Note that the lines 37 and 38 out of the Y-coupling 33 are cut-away in FIG. 8, and the two pilot/ODS assemblies are not depicted, for better clarity of other structure. Note further that a nipple 52 which is a standard part of the valve 36, is not used in this application.

Figure 5:
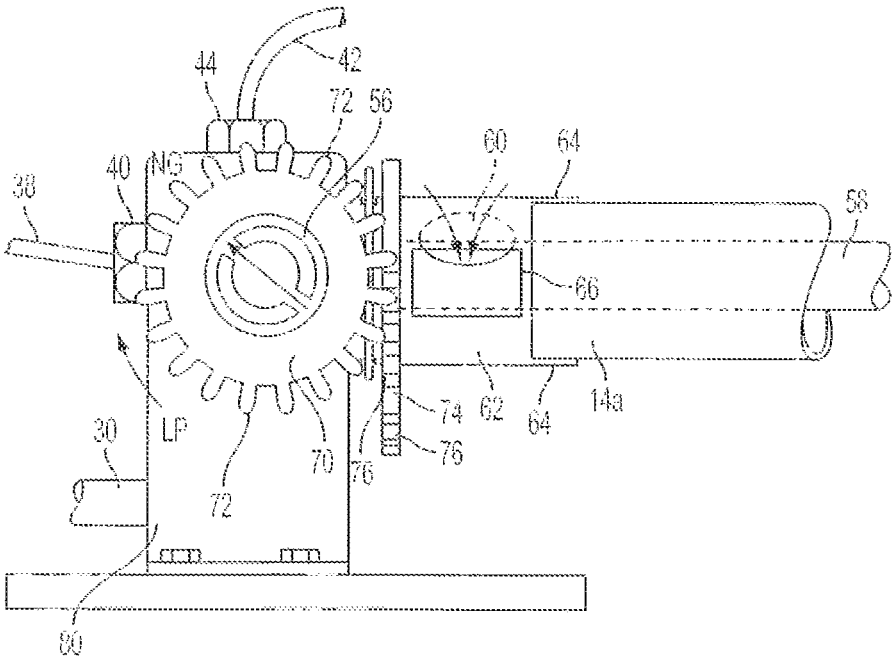
FIG. 5 is a view similar to that of FIG. 4, but with airflow substantially reduced to the mixing chamber.

NG if connected will be fed to line 37, and to line 42 as well in the other or second configuration of the selector valve (shown in the NG position in FIG. 5, for instance). Thus NG goes to both of the pilot/ODS assemblies in this second configuration.

It is considered desirable to provide a certain amount of air to the gas in order to get a flame of a yellow color, for instance. However, NG requires less air to be mixed with it than LP at the pressures of the gas being admitted to the burner tube 14. The present invention therefore provides a novel shutter device for controlling the amount of air to mix with gas within the burner tube 14.

Gas admitted to the burner tube passes through the main line 30 through the selector valve to be admitted at one end of the burner tube 14. This part of the burner tube constitutes a burner mixing chamber 14*a*, where air and gas will now be combined within the burner tube. Burner tube 14 also has a short internal tube 58 which serves to inject gas beyond the point of the openings 60 (i.e., downstream from the openings). The burner mixing chamber has a pair of openings 60 formed therein, only one of which is shown in FIGS. 2-5, for instance; the other opening 60 is on the opposite side of the part of the burner tube 14*a*, but is of like size and shape.

A sleeve member 62 is mounted concentrically with the burner tube 14*a*, so as to overlie the openings 60. The sleeve is sized so as to be just slightly greater in internal diameter than the external diameter of the burner tube 14*a*. Both the burner tube 14*a* and sleeve 62 are circular in cross section. The sleeve is rotatable about the burner tube 14*a*. One end of the sleeve member 62 is prevented from movement along the long axis of the burner tube 14*a* by a fixed stop 64 on the top, as well as bottom, of the tube 14*a*, against which an end of the sleeve abuts. The stop 64 can be a weldment, for instance.

Sleeve member 62 has a pair of cutout areas 66 formed therethrough, only one of which is shown in FIGS. 2-5; the other cutout is on the opposite side of the sleeve member 62 from that of the cutout area 66 depicted. The cutout areas 66 are shown in shape of a rectangular cutout, but the shape is not really significant. What is important is that the cutout area is sufficiently sized to provide an open area that will permit the desired amount of airflow through the burner tube openings 60 in one orientation. Similarly, the number of openings in the tube 14*a* and sizes thereof are to be selected in accordance with the amount of airflow to be permitted into the mixing chamber, and positioned in a desired manner for air introduction and flow. Here, opposed openings 60 were considered desirable, but other numbers and shapes could be considered.

Likewise, the cutouts 66 for the sleeve member 62 can be adjusted for the amount of coverage of an opening desired, such as permitting full opening, or perhaps something less than full. Other than the cutouts 66, the rest of the sleeve member 62 in this embodiment is closed, i.e., it is a solid tube except for the cutout areas 66. Thus, in a first configuration which is for supplying a significant airflow to the mixing chamber, for LP, the sleeve member 62 is placed so that the cutout areas 66 overlie the burner tube openings 60, allowing a full open position (depicted in FIGS. 2 through 4). In another or second configuration for reducing, if not eliminating airflow through the openings 60, the sleeve member 62 is placed so that the cutout areas are out of alignment with the openings 60, with solid parts of the sleeve member tube now covering the openings 60. In this particular embodiment, it was considered desirable to allow a small amount of airflow in this second configuration, for NG, which is depicted in FIGS. 5 and 8. Rotation of the sleeve member for the foregoing configurations will now be described.

The standard selector valve 36 has a locked position for the axel. The axel has an internal spring bias, which forces the axel slightly outboard (i.e., outwardly relative to the internal manifold of the valve), and places internal structure of the axel into a position where it cannot rotate. When the axel is pressed against the bias, as by someone pushing the selector knob 56 inboard, it can then be rotated. The valve will initially be set for one fuel position and initially in the locked position; this is in effect a default fuel set position. If the other fuel is to be selected, then the knob/axel is pushed in and turned to that other gas position. The selector valve 36, along with the knob 56, are mounted to a vertical bracket 80, which is fixed to the base plate arrangement 13.

In order to rotate the sleeve member 62 to a desired orientation, in association with the type of fuel selected, a pair of gears or sprockets are used. A first sprocket 70 is fixed to the axel (or it could be fixed to the knob 56, for that matter). First sprocket 70 has teeth 72 that extend radially relative to the axel in this embodiment.

A second sprocket 74 is fixed to the outside of the sleeve member 62. Second sprocket 74 has radially extending teeth 76 along at least a part of the perimeter of the second sprocket 74. Second sprocket 74 can be welded to the sleeve member, for instance. Second sprocket 74 also is associated with an endplate structure mounted to this end of the burner tube, that will shortly be discussed, in a manner which thereby locates this end of the sleeve member 62 against movement along the burner tube, but allows rotation about the axis of the burner tube.

Figure 2:
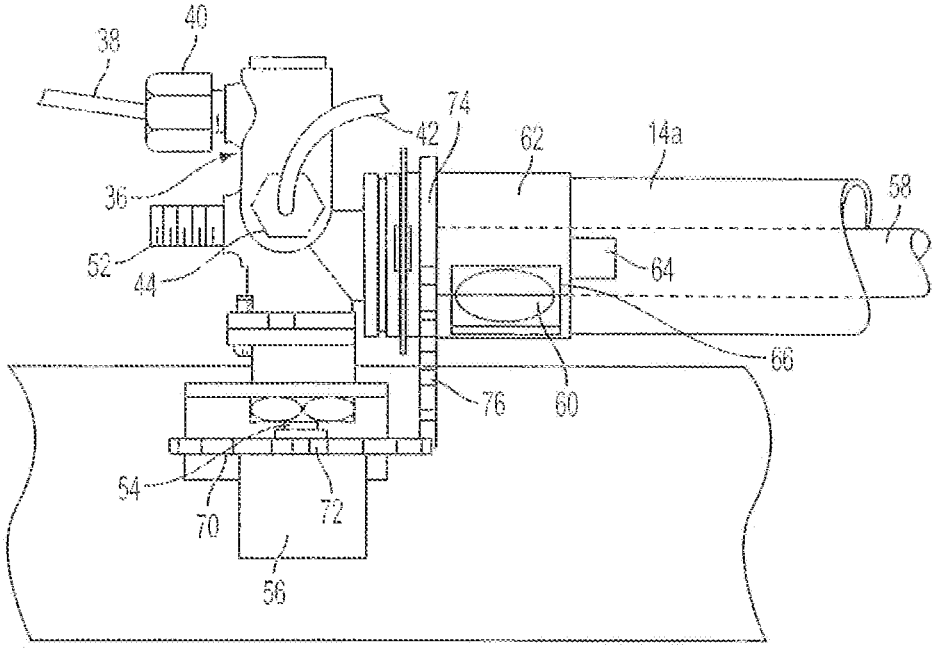
FIG. 2 is a top plan view of an embodiment of a shutter device made in accordance with the invention, applied to a burner assembly of the type shown in FIG. 1, with gears disengaged.
Figure 3:
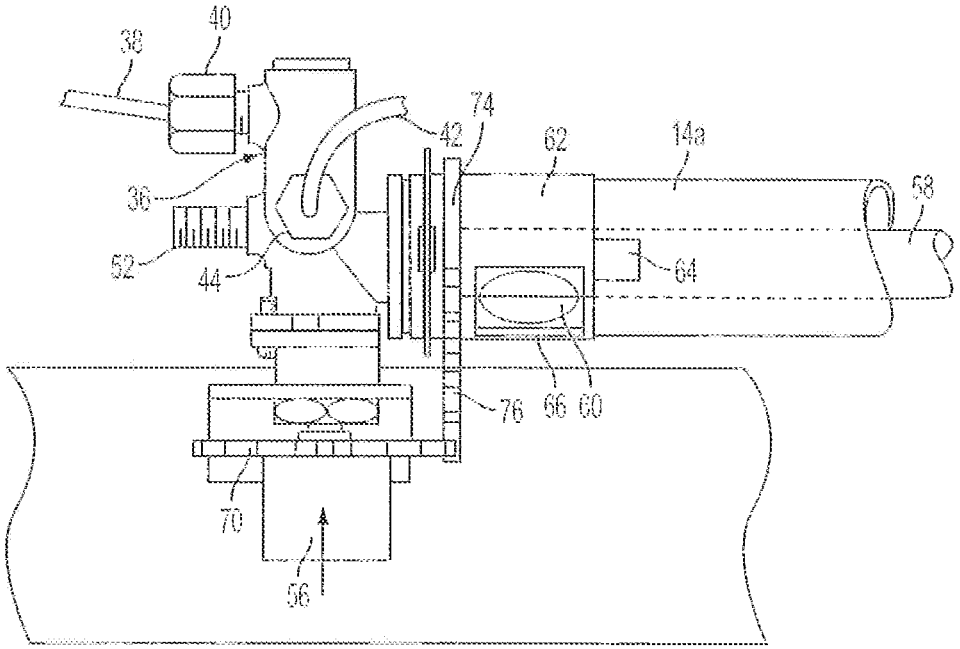
FIG. 3 is a view similar to that of FIG. 2, but with the gears engaged.

In this embodiment, the first and second sprocket teeth are out of engagement with the axel in the locked position. This out of engagement arrangement is depicted in FIG. 2. When the knob/axel is pressed inboard into the unlocked position, however, the teeth of the two sprockets now engage. This engagement position is depicted in FIG. 3 (note arrow showing knob has been pushed inwardly). When the knob/axel is thereafter rotated, first sprocket 70 turns and thereby drives second sprocket 74, which turns the sleeve member 62. The knob 56 is then released, returning to the locked position via the bias, and the sprockets are disengaged.

The aforementioned endplate structure to the burner mixing chamber will now be described. Gas from the main gas line 30 passes into the valve 36, and then from the valve through a port into the end of the burner tube. The burner gas passes through a main port through a pair of discs that are in general facial engagement. One disc is mounted to turn with the sleeve member 62, but has a plurality of small orifices therethrough, which communicate with the burner tube mixing chamber. The second disc has ports also formed therethrough, and the ports communicate with ambient air. In one configuration the ports align with the orifices of the fixed disc. Here, four orifices and four ports are used, generally located symmetrically about the discs. The second disc is fixed against rotation. When the ports and orifices align a further airflow is allowed into the mixing chamber along the axis of the burner tube mixing chamber. This is utilized in the LP mode. When in the NG mode, the ports are rotated or placed out of alignment with the orifices, and thus close this auxiliary supply of air. The number of ports and related orifices may be selected and located as desired, so long as the requisite airflow in this version is provided in the one orientation.

Figure 9:
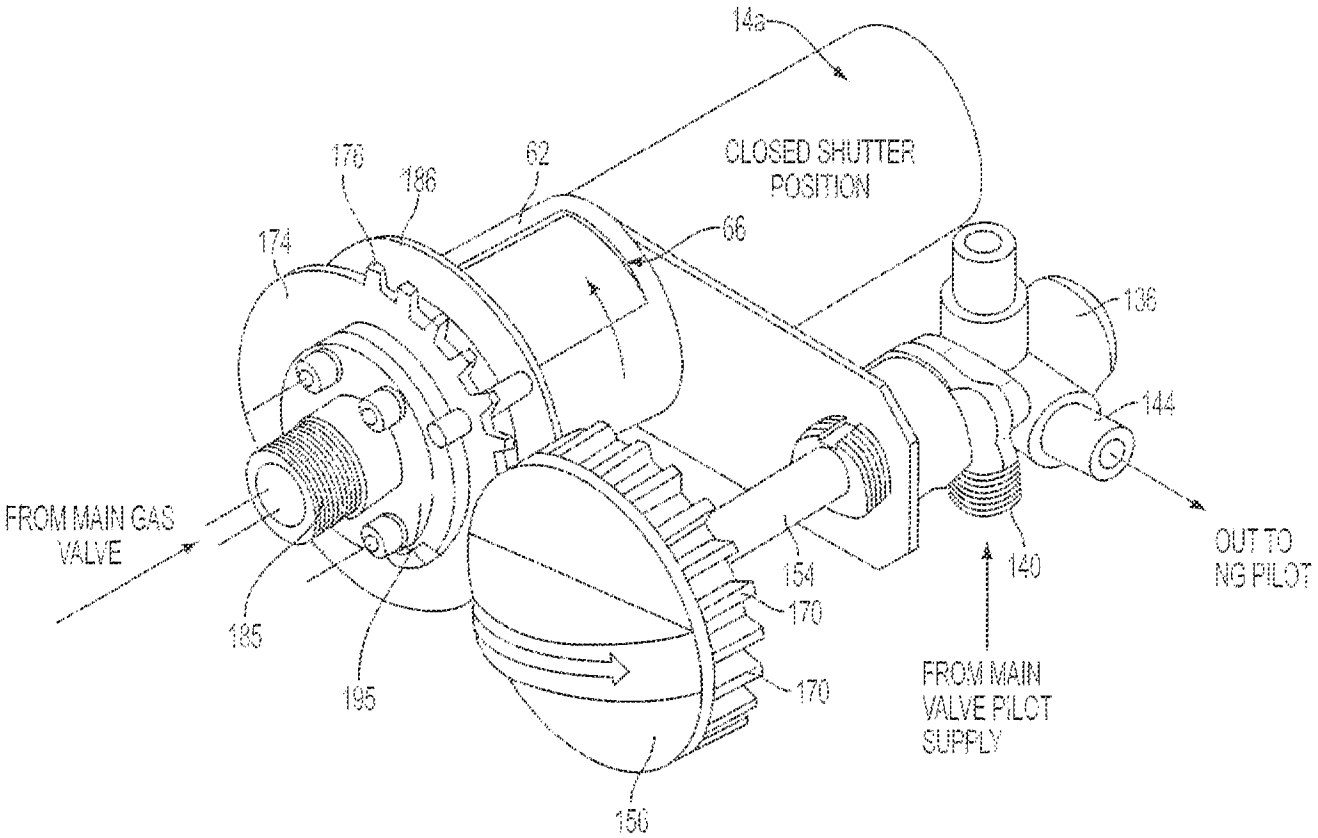
FIG. 9 shows a perspective view of a shutter mechanism in accordance with a second embodiment of the invention.
Figure 10:
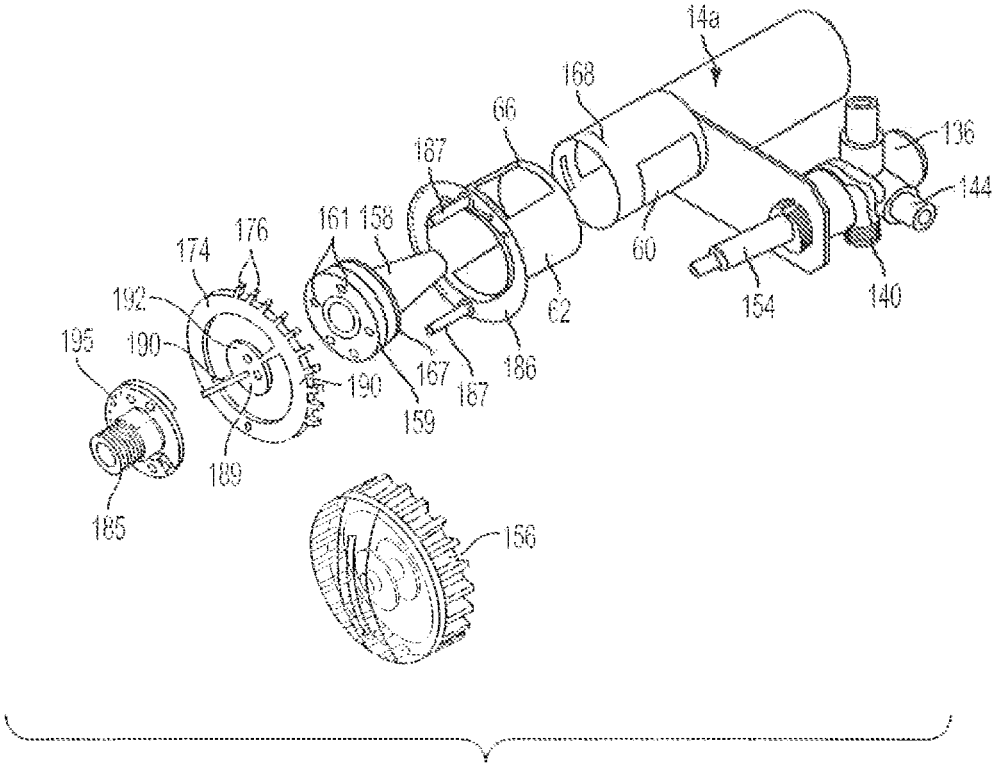
FIG. 10 is an exploded perspective view of the structure of FIG. 9.
Figure 11:
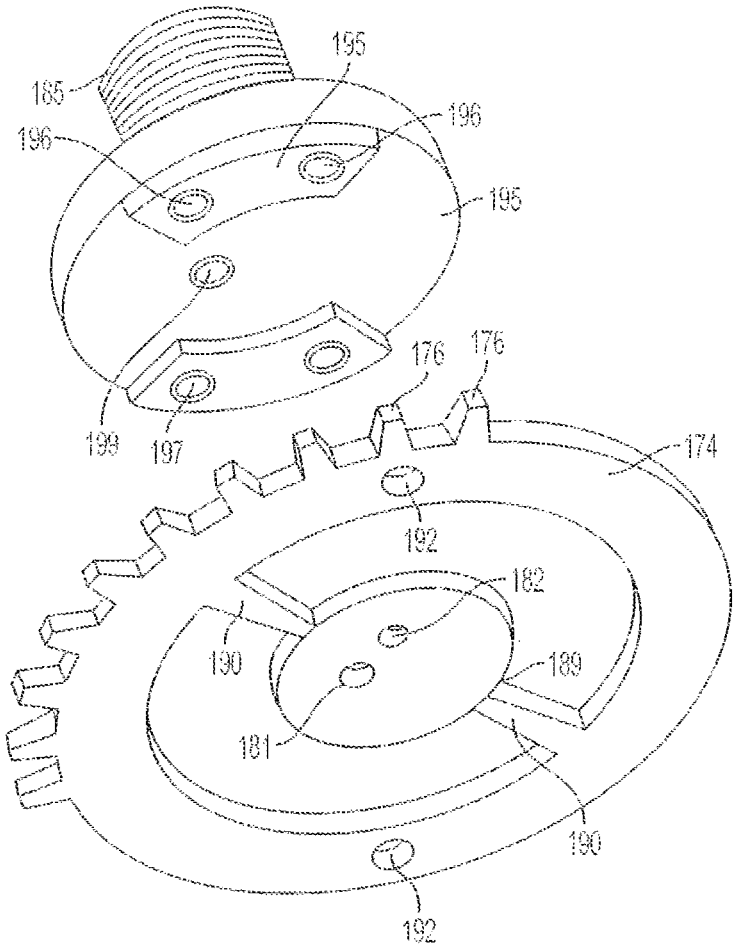
FIG. 11 is an enlarged view of a sprocket and its interface with an orifice plate in accordance with one aspect of the embodiment of FIGS. 9 and 10.

Turning now to FIGS. 9 through 11, a second embodiment of the shutter device is shown. It will be remembered that like numbers for elements indicate the same or substantially the same element throughout various embodiments. This embodiment uses a selector valve 136, which functions in similar fashion to selector valve 36. Valve 136 has a nipple 140 to which gas line 38 would be connected. Gas output to the pilot/ODS assembly 16 via gas line 42 would be via nipple connection 144. Axel 154 extends from the selector valve 136, to which a knob 156 is affixed. Knob 156 has teeth 172 provided around its perimeter.

Gas burner mixing chamber 14*a* uses a sleeve member 62 having cutout areas 66. The main gas line for the burner connects to nipple 185, such as via a pathway from the valve 136. Referring now to FIG. 10, it will be seen that sleeve member 62 has a ring 186 fixed around one end, from which extend a pair of mounting posts 187 orthogonal to the ring face. There is a gear or sprocket 174 which has teeth 176 formed around at least a part of the perimeter of the sprocket 174. Sprocket 174 has a largely open interior area, but with a disc or plate 189 in the middle of the sprocket 174, located in position via web elements or arms 190. Holes 192 receive the posts 187 to mount the sprocket 174 with the sleeve member 62. The open interior area of the sprocket allows assembly screws to pass therethrough, but not impede rotation of the sprocket.

Inboard from the sprocket 174, and extending into the mixing chamber 14*a*, is a gas injector tube element 158. The tube element 158 has a base 159 which has a plurality of apertures 161 which will receive screws (or bolts or other fixation elements) in a manner about to be described. There is an annular groove 167 around the base 159 which, when the tube element is assembled with the mixing chamber 14*a*, will receive a spring clip (not shown). The spring clip fits around the upstream end of the mixing chamber 14*a*, and extends through slots 168 formed in the mixing chamber end.

Nipple 185 for the main gas feed is part of an end cap 195, which has a plurality of through bores 196 which receive the screws (or bolts or other fixation elements) to connect the end cap 195 with the base 159 of the tube element 158. Looking at FIG. 11, it will be seen that there are a pair of standoff members 197 which fit through the open areas of the sprocket 174 interior to abut against the wall of the base 159. The end cap 195 has a gas orifice 199 through which gas from the main gas feed passes for admission into the burner tube. Disc 189 has two different sized orifices for gas passage from the gas orifice 199 through the disc 189 and thence to the injector tube 158. One orifice 181 is sized for NG, the other orifice 182 is slightly smaller in size for LP. There is an O-ring 183 in the gas orifice 199 which engages in a sliding engagement with the face of the disc 189.

It will therefore be seen that, when this embodiment of the shutter device of this invention is assembled, the sprocket 174 turns the sleeve member 62 about the mixing chamber 14*a*, to either open or close (fully or substantially) the openings 60 to the mixing chamber interior. This is accomplished by engaging the teeth 172 of the knob 156 with the sprocket teeth 176, and then turning the knob to drive the sprocket about its axis. Movement of the sprocket 174 in turn rotates the disc 189 to align with one or the other of the orifices 181, 182, depending on the type of fuel selected (NG or LP). Locking and unlocking of the knob for rotation is as described in relation to the previous embodiment.

Turning now to FIGS. 14 through 18, a third embodiment of the shutter device is shown. Where appropriate, like numbers for elements indicate the same or substantially the same elements throughout the various embodiments. This third embodiment uses a selector housing 336 which generally comprises an input housing 395, an output housing 359 and a plate 389 mounted between the input and output housings. As will be seen, the input housing 395 and output housing 359 constitute a manifold for gas flow, with the plate 389 directing the flow.

The output housing 359 contains a nozzle or gas injector tube 358 that feeds gas from the main gas line 30 into the gas burner mixing chamber 314. The output housing 359 may be affixed to the mixing chamber 314 via a screw or other fixation element (not shown). That is, the mixing chamber 314 can be formed as an integral part of the burner tube at this end of the burner tube, or it may be attached thereto. The mixing tube/burner tube terminates in an end opening, which is sized in internal diameter to fit over a mounting shoulder 363 formed around the outside of the upstream base of the gas injector tube 358. This can be a fairly snug fit, with a glue or other sealant applied, and the aforementioned screw (or the like) inserted through the sidewall of the end of the burner tube and into the mounting shoulder 363 to further affix the mixing tube/burner tube in place.

A cover or sleeve 362 is mounted concentrically with the mixing chamber 314, so as to substantially overlie a primary opening 360 in the mixing chamber 314. The sleeve 362 in this embodiment is sized so as to be just slightly greater in internal diameter than the external diameter of the mixing chamber 314. The sleeve 362 is adapted to freely slide along the longitudinal axis of the mixing chamber 314. As will be understood by those of skill, however, other types of covers could be designed to open or close one or more apertures providing air to the mixing chamber 314.

Figure 16:
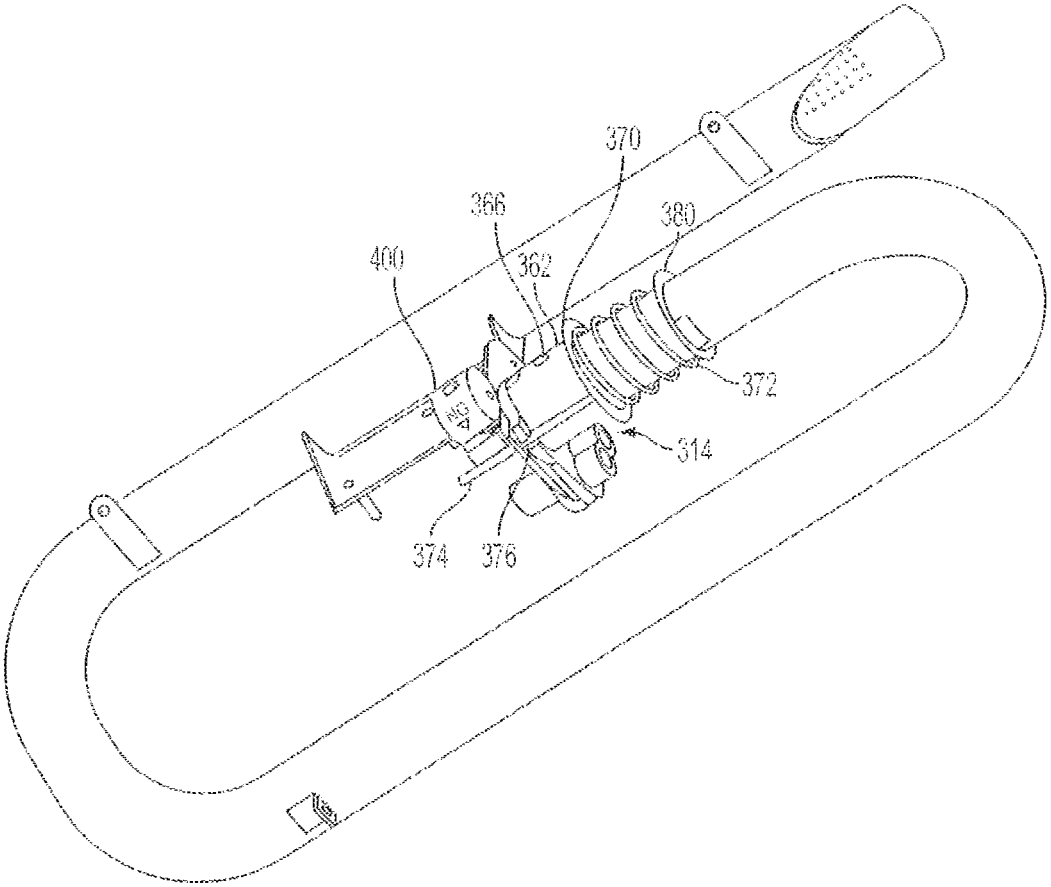
FIG. 16 is a perspective view of the shutter mechanism of FIG. 14 as applied to a burner assembly, the shutter mechanism being depicted in a closed orientation.
Figure 17:
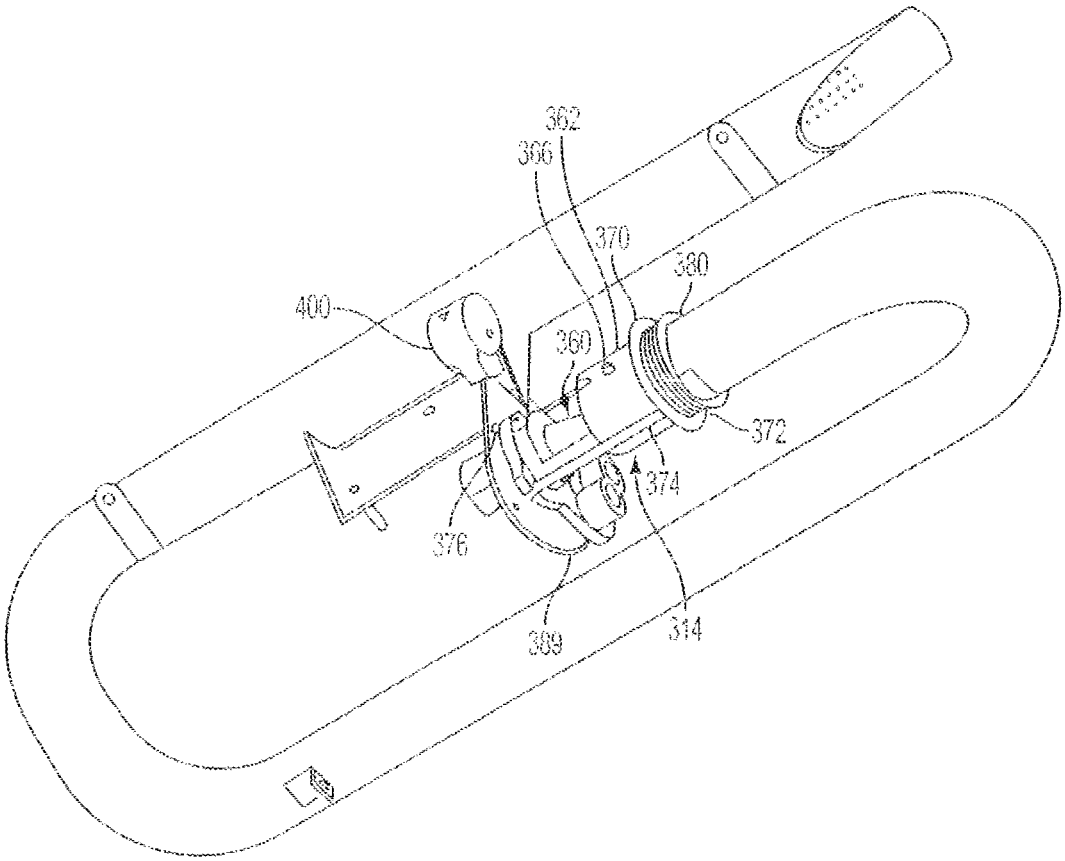
FIG. 17 is a perspective view of the shutter mechanism of FIG. 14 as applied to a burner assembly, the shutter mechanism being depicted in an open orientation.

The primary opening 360 permits ambient airflow into the mixing chamber 314 sufficient to achieve an optimal or desired burn depending upon the type of gas selected. For example, as depicted in FIG. 17, the sleeve 362 is placed in an orientation where the primary opening 360 is fully exposed, the sleeve being oriented in what may be considered a fully open position, for LP. When the burner is placed in NG mode, as shown in FIG. 16, and as will be further discussed below, the sleeve 362 is biased into a closed configuration so as to eliminate or significantly reduce ambient airflow into the mixing chamber 314 by covering the primary opening 360. The sleeve 362 may also contain a secondary opening 366, configured as a notch, aperture or the like, which extends through the sleeve so as to overlie the primary opening 360 in the "closed" configuration, such that a small amount of ambient airflow may still flow into the mixing chamber 314.

The sleeve 362 contains a flange or lip 370 mounted toward its outboard end and adapted to receive a biasing force from the biasing member 372. In the present embodiment, the biasing member 372 is a coil spring, although alternative biasing members and different arrangements to bias the sleeve 362 may also be used without departing from the spirit and scope of the invention. The biasing member 372 is adapted to apply a force to the outboard face of a radially extending flange or lip 370 formed on the sleeve concentric with the longitudinal axis of the sleeve, which longitudinal axis is also the same as that of the mixing chamber 314, with the bias influencing the sleeve 362 toward the end of the mixing chamber/burner tube, into what has been described as a closed orientation. The coil spring biasing member 372 is retained between the lip 370 mounted to the sleeve, and a second flange or lip 380 formed around the burner tube and concentric therewith mounted to the mixing chamber, thereby tending to bias the two respective lips 370, 380 apart from each another.

Mounted, typically by welding, to the inboard face of lip 370 is a rod 374. In the open position, one end of rod 374 engages the plate 389 along a face or surface of the plate which will be characterized, simply for reference, as the "downstream" face—upstream and downstream being used relative to the gas flow in this vicinity. For purposes of illustration, the direction of gas flow is indicated by the arrow in FIGS. 14 and 15. The end of the rod 374 that engages the plate is free to ride or slide along the plate, as will be seen. In one orientation, the rod serves to press the sleeve 362 against the bias of the biasing member (spring) 372, thereby maintaining the sleeve 362 in an open orientation. The plate 389 contains a notch 376 adapted to permit passage of the rod 374 through the plate 389 in another orientation, thereby disengaging the inboard end of the rod from the face of the plate and permitting the biasing member 372 to press the sleeve 362 into a closed orientation. The movement of the plate 389 will be discussed below. In order to return the shutter device to its open orientation, a person would manually move rod 374 (using the lip 370, for example) longitudinally against the biasing member 372 past the notch 376 while rotating the plate 389 about the longitudinal axis of the mixing chamber, such that the end of rod 374 will once again engage the downstream face of the plate 389, and maintain sleeve 362 in an open orientation. Other ways to "recock" the spring and sleeve can be readily understood.

As discussed, the output housing 359 contains a nozzle 358 extending into the mixing chamber 314. The nozzle 358 in this version is generally conic in cross-section. For example, in an embodiment the nozzle 358 may be approximately 0.650 inches in diameter at the base and 0.20 inches at the tip, measuring approximately 1 inch from base to tip. The nozzle also contains an O-ring or other gasket 357 seated in a groove about the inboard (upstream) opening of the nozzle 358. When assembled, the O-ring 357 is compressed between the output housing 359 and plate 389, creating a seal at the interface with the plate face.

The output housing contains a number of apertures 361 adapted to receive screws or other fixation elements, as will be described. Also located on the output housing 359 are two pilot outlets 411 and 412 adapted to receive LP or NG pilot gas, respectively, flowing through the device as discussed below. Pilot outlets 411 and 412 feed into their respective LP and NG pilot gas flow lines and to respective pilot outlets and associated ODS systems, in a manner described previously.

In the present embodiment, the input housing 395 is located inboard (upstream) of and fixed to the output housing 359 via screws or other fixation elements passing through apertures 396 in the input housing 395 and being received by apertures 361 in the output housing. Input housing 395 has a gas inlet 385 adapted to connect to the main gas line 30, whether LP or NG, via threads or other suitable fixation means. At the base of the gas inlet 385 and passing completely through the input housing 395 is a gas orifice 399. Gas from the main gas line 30 will pass through the gas orifice 399 for eventual admission into the mixing chamber 314, using a selected orifice in the plate, as will be described below. Mounted to the downstream side of the input housing 395 and surrounding the area of the burner gas inlet is an O-ring in an appropriate circular groove.

Input housing 395 also has a pilot inlet 390 similarly adapted to connect to either the LP or NG pilot gas line 38, depending upon the user's selection. Pilot inlet 390 is configured in a Y-branch orientation whereby gas is directed through one of two pilot orifices 391 and 392. The selection of which pilot orifice the pilot gas flows through is determined by the orientation of the plate 389, discussed below. Both the two pilot orifices 391 and 392, as well as the gas orifice 399, may contain a concentric groove about their inboard face for receiving a sealing element, such as an O-ring.

Located between the input housing 395 and output housing 359 is the plate 389 adapted to rotate about the longitudinal axis of the mixing chamber 314. Disposed on the plate 389 is a selection handle 400 whereby the user may select between LP and NG gas configuration. The plate 389 contains first and second gas openings 382 and 381 through which gas from the main line 30 passes from the gas orifice 399. First gas opening 382 is larger and sized for NG, while second gas opening 381 is slightly smaller and sized for LP. For example, gas opening 382 may be between 0.124 and 0.126 inches in diameter, while gas opening 381 may be sized between 0.094 and 0.096 inches in diameter. Rotation of the plate 389 via selection handle 400 aligns the appropriate one of the two gas openings with gas orifice 399 in the input housing 395. Accordingly, alignment of the gas orifice 399, the selected gas opening 381 or 382 and the nozzle 358 forms a conduit through which gas may pass into the mixing chamber 314 from the gas line 30.

Plate 389 also contains pilot openings 401 and 402 adapted to align with pilot orifices 391 and 392, respectively, depending upon the selection of either LP or NG by the user. For example, in the present embodiment, rotation of the plate 389 into the LP orientation will place gas opening 381 into alignment with gas orifice 399, while simultaneously aligning pilot opening 401 with pilot orifice 391 and pilot outlet 411. Cutouts 414 in plate 389 permit passage of the screws or other fixation elements through the plate 389 such that the fixation elements may mount the input housing to the output housing to complete the manifold, while allowing the plate to move (with the screws passing along the arcs of the cutouts).

It will be therefore be evident to those in the art that, when this embodiment is assembled, rotating the plate 389 via the selection handle 400 permits the user to easily select between LP and NG burning modes. This is accomplished by aligning the appropriate pilot orifice 391 to its respective pilot opening 401 and pilot outlet 411, while similarly aligning the appropriate gas opening 382 with the gas orifice 399 and nozzle 358, all in one rotational motion. The appropriate ambient air conditions in the mixing chamber 314 are similarly coordinated via the user's selection using the selection handle 400.

A plate 389 has been chosen in this embodiment as a presently preferred element to effect alignment of the various orifices depending on the gas flow selected. The form of the plate also lends itself to operation of the shutter, providing a surface over which the end of the rod easily travels. It will be understood that other constructs may be adapted for similar use, with the basic concept being to move an element between opposed parts of a manifold to thereby connect (and conversely block) desired input and output channels for gas flows to respective pilot assemblies and the burner (via a mixing chamber, if used, as here). The foregoing third embodiment as described eliminates the use of a selector valve of the type described with the first two embodiments having radial outlets, since the gas flows in the third embodiment are essentially along linear pathways through the manifold inlets to the manifold outlets.

Thus, while the invention has been described with respect to certain embodiments, variations and modifications will be recognized by those of skill in the art which will nonetheless come within the spirit and scope of the invention, as further set forth in the claims which follow.

What is claimed is:

1. A selector mechanism for selecting and routing a first or a second gas flow to a burner unit of a gas-fired appliance, the burner unit having a burner tube with a mixing chamber, the mixing chamber having at least one air opening to allow an airflow into the mixing chamber to mix with a gas flow passing through the mixing chamber, the burner unit further including a pilot light, associated ODS and first and second pilot gas lines related to the first and second gas flows, comprising:

a manifold with a burner gas inlet for a burner gas flow and a pilot gas inlet for a pilot gas flow, a burner gas outlet to the mixing chamber, a first pilot gas outlet to the first pilot gas line and a second pilot gas outlet to the second pilot gas line;

a plate member mounted to move in said manifold between said inlets and outlets, said plate member having a handle part located for manual movement of said plate between a first orientation for the first gas flow and a second orientation for the second gas flow, said plate member including at least one pilot gas aperture therethrough which communicates said pilot gas inlet with either said first or said second pilot gas line depending on either said first or said second orientation, and at least one burner gas aperture therethrough which communicates said burner gas inlet with said burner gas outlet;

a shutter mechanism for controlling an airflow into the burner mixing chamber, the mixing chamber being within a burner part which is tubular and having a longitudinal axis, said shutter mechanism comprising a cover mounted to overlie the mixing chamber opening in one orientation to reduce if not substantially close airflow through the mixing chamber opening, and to expose the mixing chamber opening in another orientation, said cover moving along said longitudinal axis according to selection of the first or second gas flow, and a biasing member biasing said cover to move between said one cover orientation or another cover orientation, said biasing member being actuated by the selector mechanism, wherein the selector mechanism further includes a rod connected to said cover and having a rod end engaging said plate member of said manifold and pressing said cover against the bias of said biasing member in said one cover orientation, said rod end being disengaged from said plate in said another cover orientation and the bias moving said cover.

2. The selector mechanism of claim 1, wherein said plate member has a first and a second burner gas aperture, and either said first or said second aperture communicates with said burner gas outlet depending on either said first or said second orientation.

3. The selector mechanism of claim 2, wherein the second gas flow is of a different type of gas from the first gas flow.

4. The selector mechanism of claim 3, wherein the first gas flow is NG, and the second gas flow is LP.

5. A selector mechanism for selecting and routing a first or a second gas flow to a burner unit of a gas-fired appliance, the burner unit further including at least one pilot light, comprising:

a manifold with a burner gas inlet for a burner gas flow, and a burner gas outlet, a selector member mounted to move in a plane in said manifold between said burner gas inlet and burner gas outlet, said selector member having a handle part located for manual movement of said selector member between a first orientation for a first gas flow and a second orientation for a second gas flow, said selector member further including a first burner gas aperture and a second burner gas aperture, said first or said second burner gas aperture communicating with said burner gas outlet depending on either said first or said second orientation being selected through movement of said selector member in said plane to align said first or second burner gas aperture with said burner gas outlet;

a shutter mechanism for controlling an airflow into a burner mixing chamber, said mixing chamber being within a burner conduit part having a longitudinal axis, said mixing chamber having an air opening formed thereon, said shutter mechanism comprising a cover mounted to overlie said mixing chamber opening in one of a first cover orientation or second cover orientation to reduce if not substantially close airflow through a mixing chamber opening, and to expose said mixing chamber opening in the other of said first or second cover orientations, said cover moving along said longitudinal axis according to selection of the first or second gas flow, and a biasing member biasing said cover to move between said first and second cover orientations, said biasing member being actuated by the selector mechanism, wherein the selector mechanism further includes a rod connected to said cover and having a rod end engaging said selector member of said manifold and pressing said cover against the bias of said biasing member in one of said first or second cover orientations, said rod end being disengaged from said selector member in the other of said first or second cover orientations and the bias moving said cover.

6. The selector mechanism of claim 5, wherein the burner unit includes a first pilot gas line for the first gas line and a second pilot gas line for the second gas flow, said manifold further including a pilot gas inlet and a first pilot gas outlet and a second pilot gas outlet, said selector member including at least one pilot gas aperture therethrough which communicates said pilot gas inlet with said first or second pilot gas outlets, depending on which of said first or said second orientation is selected.

7. The selector mechanism of claim 5, wherein the burner unit is operable on two different kinds of fuel, and said first orientation or said second orientation is selected based upon the kind of fuel being supplied, the burner unit further including a pilot light associated with a respective pilot gas line from a respective pilot gas outlet.

8. The selector mechanism of claim 7, wherein the burner unit has an ODS associated with a respective pilot light.

9. The selector mechanism of claim 8, wherein the first gas flow is NG, and the second gas flow is LP.

10. The selector mechanism of claim 5, wherein said selector member is a plate.

11. The selector mechanism of claim 5, wherein said selector member is a part having a generally flat planar face on front and back sides.

12. The selector mechanism of claim 11, wherein said selector member is mounted between an interior inlet side and an interior outlet side of said manifold, with each face of said front and back sides being in sliding engagement with a respective interior outlet and interior outlet side of said manifold.

* * * * *